US006901835B1

(12) United States Patent
Chamlee

(10) Patent No.: US 6,901,835 B1
(45) Date of Patent: Jun. 7, 2005

(54) CONE AND CHARGE EXTRACTOR

(75) Inventor: William D. Chamlee, Texarkana, TX (US)

(73) Assignee: Day & Zimmerman, Inc., Texarkana, TX (US)

( * ) Notice: Subject to any disclaimer, the term of this patent is extended or adjusted under 35 U.S.C. 154(b) by 0 days.

(21) Appl. No.: 10/723,914

(22) Filed: Nov. 26, 2003

(51) Int. Cl.[7] ..... F42B 33/06
(52) U.S. Cl. ..... 86/49; 86/50; 29/700
(58) Field of Search ..... 86/49, 50; 29/700

(56) References Cited

U.S. PATENT DOCUMENTS 1,492,924 A * 5/1924 Knight ..... 134/5
1,492,925 A * 5/1924 Knight ..... 134/5
1,492,956 A * 5/1924 Bots ..... 134/5
4,805,571 A * 2/1989 Humphrey ..... 123/316
5,000,516 A * 3/1991 Kolle et al. ..... 299/16
5,526,877 A * 6/1996 Winz ..... 166/88.2
5,789,695 A * 8/1998 Scherer et al. ..... 86/49
5,974,937 A 11/1999 Doughty et al.
6,470,783 B2 * 10/2002 Ito et al. ..... 86/50
2002/0104492 A1 * 8/2002 Cowans ..... 123/48 R

FOREIGN PATENT DOCUMENTS

JP 6-88700 * 3/1994

* cited by examiner

*Primary Examiner*—Stephen M. Johnson
(74) *Attorney, Agent, or Firm*—Caesar, Rivise, Bernstein, Cohen and Pokotilow, Ltd.

(57) ABSTRACT

An extractor and method for safely releasing an explosive and liner from a munition is disclosed. An exemplary extractor includes a support device connected to the casing of the munition and adapted to stabilize the munition as the explosive is released from the dome end of the munition casing and a fluid port adjacent the dome end of the casing and adapted to introduce a high pressure fluid through the dome end to the explosive to separate and release the explosive from the dome end. An exemplary method for releasing an explosive and liner from a dome end of a munition casing includes inserting a fluid port into a dome end of the casing and introducing a fluid through the fluid port to the explosive to release and separate the explosive from the dome end and to shear the mechanical coupling between the liner and the casing.

20 Claims, 4 Drawing Sheets

CONE AND CHARGE EXTRACTOR

FIELD OF INVENTION

This invention relates to generally to the field of disarming munitions. In particular, this invention relates to extracting a compound (e.g., explosive) from a shaped munition (e.g., grenade).

BACKGROUND OF THE INVENTION

Due to military build-up, shelf-life expiration and technical advances, munitions are becoming obsolete or in excess of a quantity desired to be kept in reserve. This presents a need to disarm and recover salvageable material of munitions. For example, for munitions such as grenades, there is a need to recover the grenades and remove the lead charge, explosive and cone liner from the grenade, leaving a recovered grenade casing.

Demilitarization programs have been in operation to disarm and recover salvageable material of artillery rounds loaded with munitions, including M42, M46, M77 and M80 general purpose type grenades. Typically, the fuse housing and fuse slider are secured to prevent the fuse slider from moving into an armed position. Next, a hole (typically ⅜ of an inch in diameter) is mechanically punched through the grenade casing where the flange of a cone-shaped liner is attached to the interior of the casing, deforming the liner and exposing the explosive charge inside the grenade. The explosive charge (also referred to simply as explosive) in the grenade is then burned away in a controlled burning apparatus known as an Explosive Waste Incinerator (EWI) or, alternatively, the entire grenade assemblies are mass detonated on a controlled demolition field.

There are several disadvantages of these prior art methods. None of the explosive material is salvaged. The EWI process takes a long time to burn away the entire explosive, and must be carefully controlled to minimize high order detonation explosive burning. Moreover, the burning away of the explosive produces toxic fumes in the EWI which must be contained and detoxified. Thus, this prior art method contributes to high operating cost, high equipment maintenance cost and does not salvage any of the explosive material. Also, after mass detonations there is potential for ground water and air contamination.

Day & Zimmermann, Inc. disclosed a better approach for removing the explosive charge from the grenade by removing most of the explosive before the EWI. In U.S. Pat. No. 5,974,937, entitled Method and System for Removing an Explosive Charge From a Shaped Charged Munition, and issued Nov. 2, 1999, the contents of which are incorporated by reference herein in their entirety, a hollow punch die is inserted through an open end of the grenade casing to gouge the cone out of the assembly and remove (e.g., drill or punch) most of the explosives out of the casing. The removed explosive can then be salvaged for use in commercial demolition charges and the EWI processing can be performed at higher pass through rates and with less toxic fumes and residue. However, this improved process leaves a significant amount of explosives inside the body, since, due to safety considerations, the die or drill must not come in contact with the metal components. Therefore, the EWI processing is still required to remove the residual explosives, producing toxic fumes and residue. While the improved approach is effective as a demil operation, it reduces the opportunity to reclaim the casing and liner for subsequent reuse and requires an incinerator to complete the explosive removal process.

The present inventor realized that it would be even more beneficial to develop an approach that safely removes the lead charge, substantially all of the explosive, and the cone-shaped liner from the munition body (e.g., casing). Recovered munition or grenade bodies can then be reused for new production or reclaimed and recycled as scrap metal. Explosives can be reused for ammunition or sold for mining operation. The cones, typically copper, can be sold as scrap.

SUMMARY OF THE INVENTION

The invention relates to an apparatus and method for removing an explosive from a shaped charged munition. A compound (e.g., explosive, packed powder, solid substance) is released from a dome end of a munition casing with a high pressure fluid (e.g., hydraulic) system including a fluid (e.g., water) pump and a water port in communication with the compound. While the preferred fluid is water, other fluids may be used to urge the compound away from the dome end.

In an exemplary embodiment of the present invention, an extractor releases a compound from a dome end of a casing that also has an open end opposite the dome end. The extractor includes a support device connected to the casing and adapted to stabilize the casing as the compound is released from the dome end, and a fluid port adjacent the dome end of the casing and adapted to introduce a fluid through the dome end to the compound to release the compound by separating the compound from the dome end.

The casing and the compound are typically elements of a munition (e.g., grenade). While not being limited to a particular theory, the munition typically includes a liner inside the casing with a flange of the liner mechanically coupled to the casing and directed toward the open end. In this example, the compound is enclosed in the casing between the dome end and the liner, and the support device may include a dejeter slidingly engaged within the open end of the casing adjacent the liner.

In accordance with another exemplary embodiment, the invention includes a method for releasing a compound from a dome end of a casing having an open end opposite the dome end. The exemplary method includes the steps of connecting a support device to the casing to stabilize the casing, urging the dome end of the casing against a fluid port, and introducing a fluid through the fluid port to the compound to release the compound by separating the compound from the dome end. The method may also include removing the released compound from the casing.

In accordance with yet another exemplary embodiment, the invention includes a method for releasing an explosive from a munition having a casing with an open end opposite a dome end, a liner mechanically coupled inside the casing and directed toward the open end, and the explosive enclosed in the casing between the dome end and the liner. The exemplary method includes the steps of inserting a fluid port into the dome end of the casing and introducing a high pressure fluid through the fluid port to the explosive to release the explosive by separating the explosive from the dome end and to shear the mechanical coupling between the liner and the casing. The method may also include removing the released explosive from the casing.

In accordance with still another exemplary embodiment, the invention includes an apparatus for releasing a compound from a dome end of a casing having an open end opposite the dome end. The exemplary apparatus includes means for connecting a support device to the casing to stabilize the casing, means for urging the dome end of the casing against a fluid port, and means for introducing a fluid through the fluid port to the compound to release the compound by separating the compound from the dome end. The apparatus may also include means for removing the released compound from the casing.

In accordance with yet still another exemplary embodiment, the invention includes an apparatus for releasing an explosive from a munition having a casing with opposite open and dome ends, a liner mechanically coupled inside the casing and directed toward the open end, and the explosive enclosed in the casing between the dome end and the liner. The exemplary apparatus includes means for inserting a fluid port into the dome end of the casing and means for introducing a high pressure fluid through the fluid port to the explosive to release the explosive by separating the explosive from the dome end and to shear the mechanical coupling between the liner and the casing. The apparatus may also include means for removing the released explosive from the casing.

The described characteristics of the invention are easily discernable from the drawings. Moreover, further scope of applicability of the present invention will become apparent in the description given hereafter. However, it should be understood that the detailed description and specific examples, while indicating preferred embodiments, are given by way of illustration only, since the invention will become apparent to those skilled in the art from this detailed description.

BRIEF DESCRIPTION OF THE DRAWINGS

This invention will be described in conjunction with the following drawings, in which like reference numerals designate like elements and wherein.

DETAILED DESCRIPTION OF THE INVENTION

The present invention is directed to an extractor and a method for extracting a compound (e.g., explosive) from a casing (e.g., munition, grenade). While not being limited to a particular theory, the invention is described below with regard to removal of an explosive from an improved conventional munition (ICM) grenade. A shaped charge munition is generally understood to include a casing enclosing an explosive charge having a generally conical indentation or shape, oriented such that the open base of the conical shape is directed toward an open end of the casing to concentrate the blasted effect in that direction. However, it is understood that the invention is adaptable to other shaped charge munitions, with and without liners or a stackable configuration.

Figure 1:
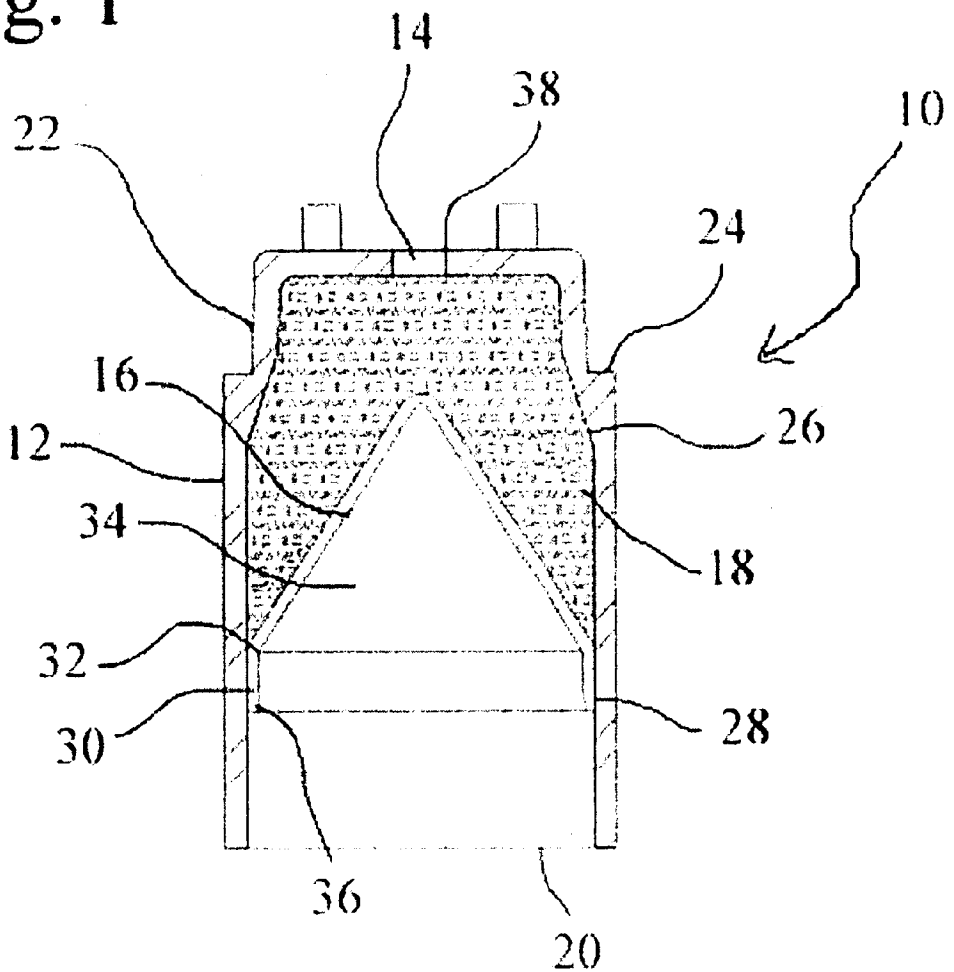
Fig. 1 PRIOR ART
FIG. 1 is a sectional view of an exemplary prior art grenade body loading assembly.

FIG. 1 is a cross section view of a typical ICM grenade body loading assembly 10. When coupled with an initiating device (e.g., fuse), the grenade body loading assembly 10 (hereinafter referred to as grenade body) becomes an ICM grenade that is typically carried to a target in large gun projectiles or rocket warheads. The grenade body 10 has a casing 12, a lead charge 14, a liner 16, and an explosive 18. The casing 12, preferably formed of metal, is hollow with an open end 20 and a closed dome end 22 opposite the open end.

The exterior of the casing 12 is generally cylindrical and has a smaller diameter near the dome end 22 to permit stacking of the grenades in a delivery projectile. This can best be seen in FIG. 1 by noting that the casing 12 has a uniform outside diameter from the open end 20 to a dome shoulder 24 and a smaller outside diameter from the shoulder 24 to the dome end 22. To stack grenades in a delivery projectile, the dome end 22 of one grenade is inserted into the open end 20 of an identical second grenade until the rim of the open end of the second grenade rests on the dome shoulder 24 of the first grenade.

The interior of the casing 12 is also generally cylindrical with an interior side wall 26 having a reduced bore diameter near the dome shoulder 24. The interior side wall 26 also has a small reduction in bore diameter near the open end 20 to form a ridge 28 that is adapted to couple with the liner 16.

While not being limited to a particular theory, the liner 16 is a cone shaped copper structure having a flange 30 extending from an open base 32 of a cone shaped section 34. The flange 30 preferably includes a groove 36 around the outer circumference wall of the flange 30 and is adapted to be mechanically coupled to the ridge 28 of the casing 12. The liner 16 is attached to the interior side wall 26 of the casing 12 by press fitting the flange 30 against the interior side wall until the groove 36 is swedged or coupled about the ridge 28. A charge of explosive 18 (e.g., RDX type) is enclosed in the area between the dome end 22 and the liner 16. The casing 12 includes an opening 38 at the dome end 22 that houses the lead charge 14. The lead charge 14 is press fitted into the opening 38 adjacent the explosive 18. Preferably an adhesive backed aluminum foil layer is attached on the inside of the dome end between the explosive 18 and the lead charge 14 to form an internal seal between the two. Details of the aluminum foil are not important to the understanding of the invention.

The cone shaped cavity configuration of the explosive 18 shown in FIG. 1 is characteristic of shaped charge munitions. Detonation of the explosive 18 directs hot expanding gases from the explosion toward the axis of the cone shaped liner 16 and out the open end 20 of the casing 12, giving the blast a directional effect. The typically copper liner 16 is compacted along its axis and melts almost instantaneously from the explosion, where it is ejected as a high velocity molten jet out of the open end 20 of the casing 12. This directional blast and molten metal jet provide armor penetration to a much greater depth than an omni-directional explosion. The casing 12 is typically made of steel, and breaks up from the blast of the explosion into fragments to provide anti-personnel shrapnel.

Figure 2:
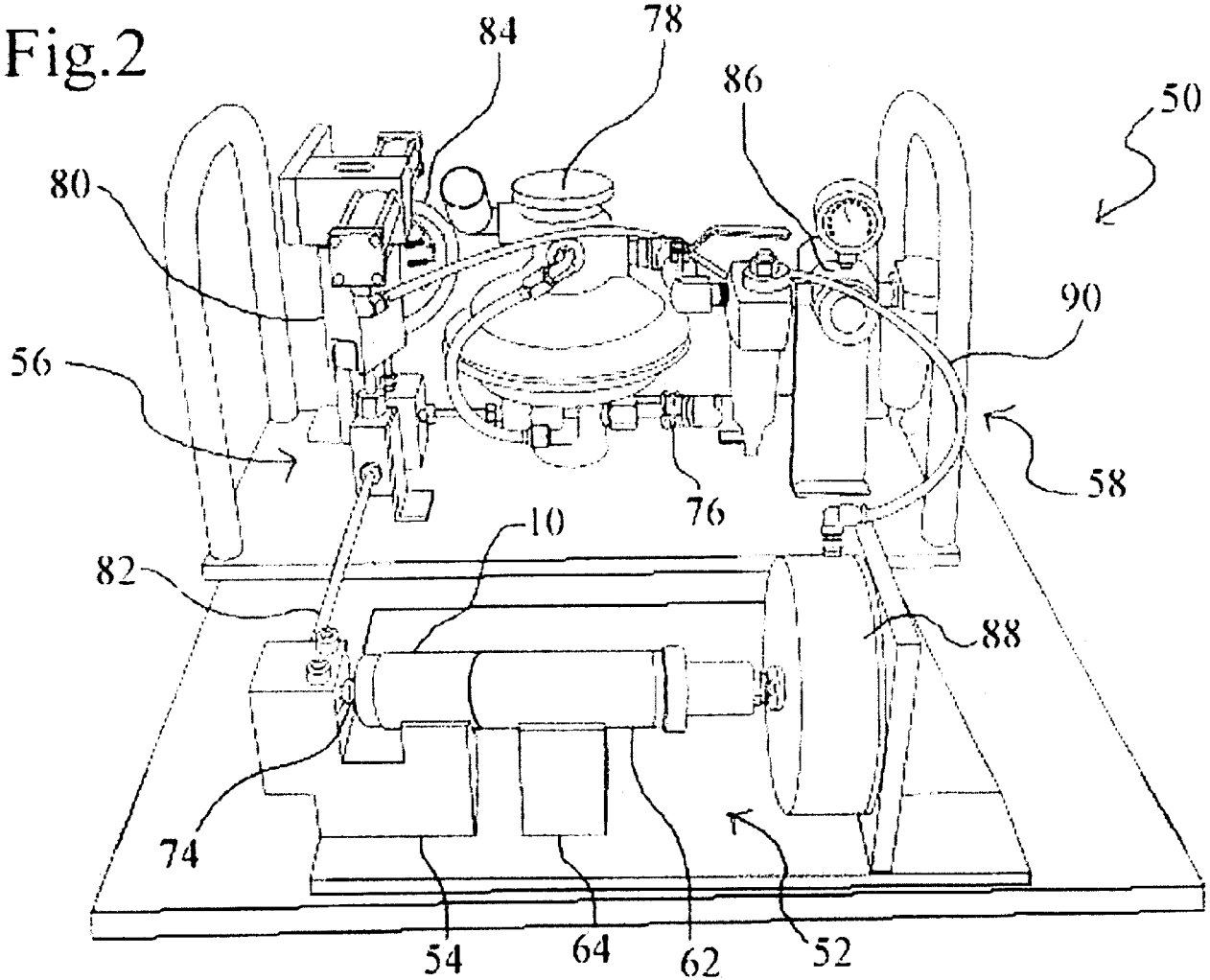
FIG. 2 is a perspective view illustrating an extractor in accordance with a preferred embodiment of the invention.

FIG. 2 shows a perspective view of the preferred exemplary embodiment of the invention. As shown in FIG. 2, an extractor 50 includes a support device 52, a grenade support 54, a fluid source apparatus 56, and an air source apparatus 58. The support device 52 stabilizes the grenade body 10 and defeats or absorbs the armor penetration capability of the grenade in the unlikely event of a detonation during the extraction process. The grenade support 54 holds the grenade body 10 and supports the casing 12 during the extraction process. It should be noted that the support device 52 could be considered to include the grenade support 54 even though they are generally discussed separately. The fluid source apparatus 56 introduces fluid, preferably under high pressure, into the dome end 22 of the grenade body 10 and between the explosive 18 and the interior side wall 26. The fluid source apparatus 56 pushes the fluid inside the dome end 22 with enough force to move the explosive and shear the swedged liner 16 from the ridge 28 of the casing 12. The explosive 18 and liner 16 are loosened and released from the dome end 22 by this process and easily removed from the casing 12 (e.g., in a subsequent tapping and rinsing operation). The air supply 58 acts on the support device 52 and the fluid source apparatus 56, pushing the lead charge 14 into the explosive 18 and providing an entry point for the fluid to flow from the fluid source apparatus.

Figure 3:
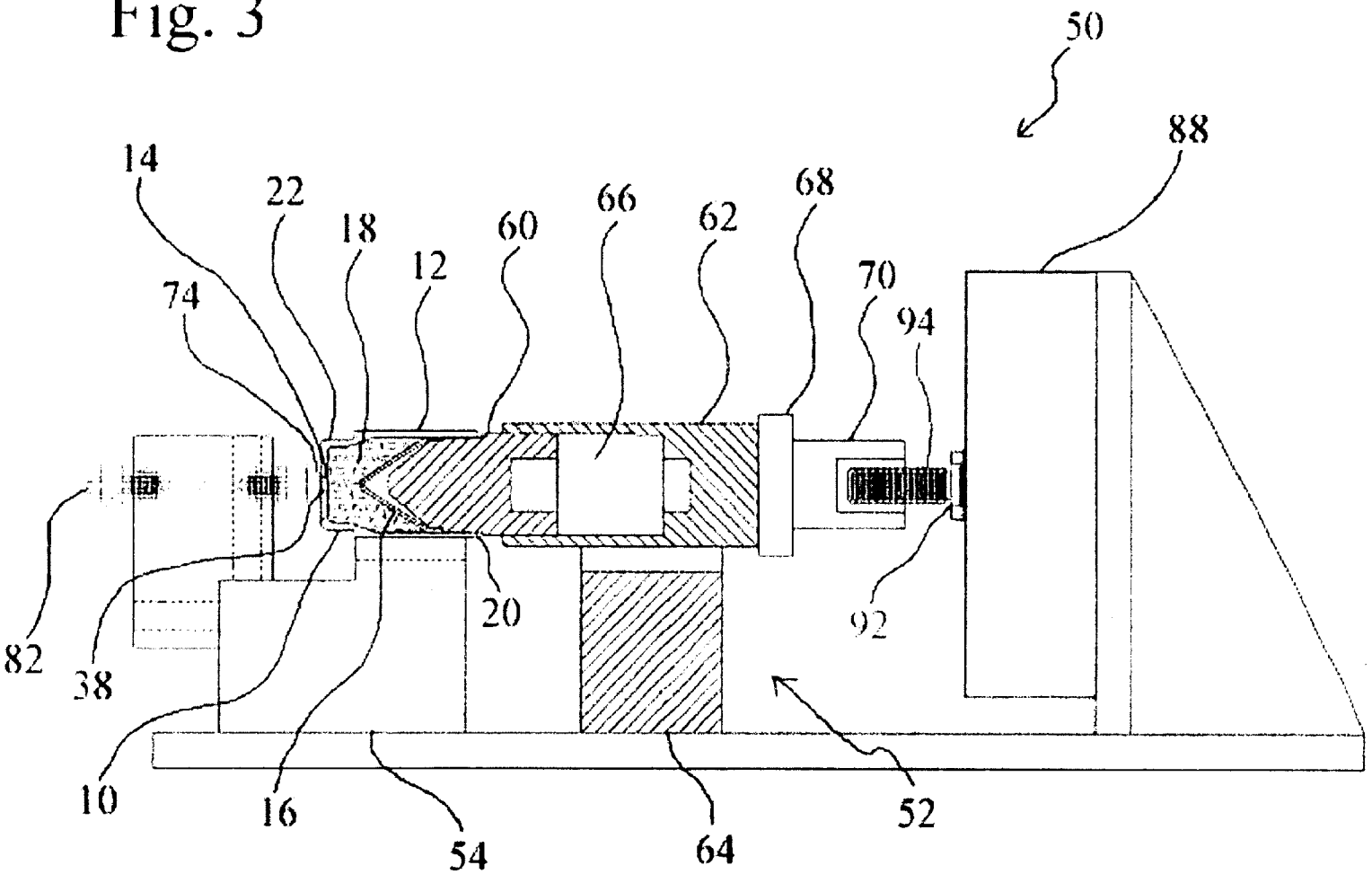
FIG. 3 is a partial longitudinal sectional view of the extractor of FIG. 2 in a start position.
Figure 4:
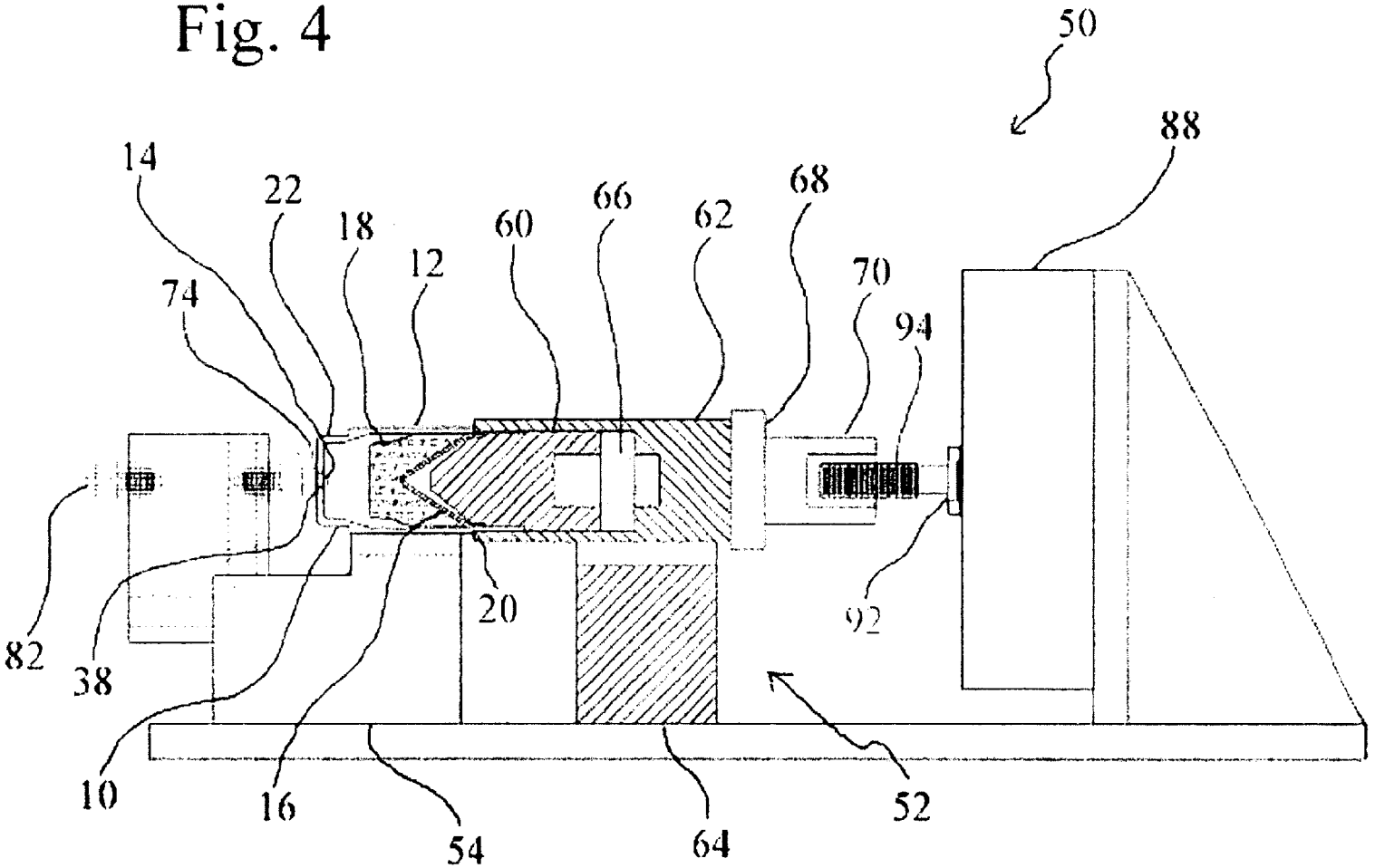
FIG. 4 is a partial longitudinal sectional view of the extractor of FIG. 2 in a push-out position.

The support device 52 includes a dejeter 60, a dejeter housing 62, a dejeter housing support 64 and a back-up spring 66. The dejeter 60 and back-up spring 66 are not shown in FIG. 2 as both are at least partially enclosed in the dejeter housing 62 and in the casing 12. As can be seen in FIGS. 3 and 4, the dejeter 60 is slidingly engaged within the dejeter housing 62 and the back-up spring 66 is located therebetween. The back-up spring 66 is preferably a compression spring and acts on the dejeter 60 by urging the dejeter away from the dejeter housing 62. The dejeter 60 is adapted to extend out of the dejeter housing 62 and into the open end 20 of the grenade body 10. While not being limited to a particular theory, the dejeter 60 shown in FIGS. 3 and 4 is held in position against the casing 12 and liner 16 by the back-up spring 66, which is also referred to as a compression spring. In this position, the dejeter 62 serves to defeat the armor penetrating capability of the grenade in the unlikely event of a detonation during the extraction process. The dejeter 60 also serves as a stabilizer to hold the liner 16 in position during the extraction process until the fluid pressure inside the grenade reaches a force sufficient to shear the liner from the ridge 28 of the grenade body 10. It should be noted that the extractor 50 is preferably enclosed in a protective housing (e.g., cubicle) and operated remotely for safety.

The dejeter housing 62 sits on and is slidingly engaged with the dejeter housing support 64. As shown in FIGS. 3 and 4, the dejeter housing 62 preferably includes a hub 68 at its closed end opposite the dejeter 60 that is at the open end of the dejeter housing. The hub 68 includes a sleeve 70 and connects to the air source apparatus 58 as will be described in greater detail below. The dejeter housing support 64 stays the dejeter housing 62 in axial alignment with the grenade body 10.

Referring to FIG. 2, the fluid source apparatus 56 includes a fluid port 74 in communication with a fluid supply 76 via a fluid pump 78, a valve assembly 80 and a fluid supply conduit 82. The fluid source apparatus 56 also includes a fluid pressure gauge 84 in communication with the valve assembly 80 for measuring the fluid pressure of the fluid source apparatus. The fluid port 74 abuts the grenade body 10 at the dome end 22 of the grenade body. In particular, as shown in FIG. 3, the fluid port 74 is aligned with the opening 38 in the dome end 22 and is in communication with the lead charge 14. The fluid port 74 introduces a fluid through the opening 38 to the explosive 18 by pushing the lead charge 14 into the explosive, providing an entry point for the fluid to follow.

Still referring to FIG. 2, the fluid enters the fluid source apparatus 56 via the fluid supply 76. The fluid supply 76 is preferably a hose connected to a supply of the respective fluid at its distal end, and is connected to the fluid pump 78 at its proximal end. The fluid pump 78 raises fluid pressure by compressing and pushing the fluid to the fluid conduit 82 and the fluid port 74 via the valve assembly 80. The valve assembly 80 controls the amount of fluid that flows from the fluid pump 78 to the fluid supply conduit 82. The fluid pressure gauge 84 is preferably connected to the valve assembly 80 and measures the pressure of the fluid passing through the valve assembly. The fluid supply conduit 82 extends from the valve assembly 80 through the grenade support 54 to the fluid port 74, as seen in FIGS. 2–4. This arrangement of the fluid conduit 82 through the grenade support 54 is not critical to the scope of the invention, however, it is noted that with this arrangement, the grenade support 54 also provides structural support to the fluid conduit 82 and to the fluid port 74.

As can be seen in FIG. 2, the air source apparatus 5 8 includes an air pressure regulator 86 that sends air to a compression cylinder 88 via an air supply conduit 90. The air supply conduit 90 receives the air, preferably under pressure from an air source (e.g., air tank), with the pressure of the incoming air regulated by the air pressure regulator 86 in a manner readily understood by a skilled artisan. The air travels through the air supply conduit 90 to the compression cylinder 88, where it is compressed to increase its pressure. As can best be seen in FIGS. 3 and 4, the compression cylinder 88 includes a rod 92 that couples the compression cylinder and the dejeter housing 62 and provides fluid communication with the dejeter housing to push the dejeter housing toward the grenade body 10. The rod 92 includes a band 94 that is externally threaded and adapted to slide along the longitudinal axis of the rod as air is supplied to the compression cylinder 88 from the air source apparatus 58.

As noted above, the hub 68 and sleeve 70 are part of the dejeter housing 62 and are adapted to connect the dejeter housing to the rod 92. The sleeve 70 has internal threads that mate with the external threads of the band 94, connecting the dejeter housing 62 to the compression cylinder 88. Via this connection, the dejeter housing 62 moves with the band 94 as air is supplied to the compression cylinder 88 and out of the rod 92. Accordingly, as can best be seen in FIG. 4, the compression cylinder 88 is adapted to push air out of the rod 92 against the dejeter housing 62, urging the dejeter housing toward the grenade body 10, such that the dejeter housing abuts the casing 12. In fact, the compression cylinder 88 continues to pneumatically push the dejeter housing 62 and, upon contact with the casing 12, also moves the casing 12 toward the fluid port 74. This movement of the casing 12 causes the fluid port 74 to slide into the opening 38 of the dome end 22 against the lead charge 14, sealing the opening with the fluid port, pushing the lead charge into the explosive 18 and creating a fluid path from the fluid port to the explosive.

The fluid is introduced from the fluid port 74 through the opening 38 and flows between the interior side wall 26 and the adjacent surface of the explosive 18. The fluid is continually forced into the grenade body 10, creating enough pressure in the dome end 22 to move the explosive 18 and shear the swedged liner 16 from the ridge 28 of the casing 12. The liner 16 is pushed over the ridge 28 and the explosive 18 detaches and is released from the dome end 22 of the casing 12, thereby loosening both the liner and the explosive to a push-out position for removal from the grenade body 10, preferably in a subsequent tapping and rinsing operation. The loosened explosive 18 and liner 16 can also be easily removed from the grenade body 10 in other alternative operations (e.g., suction, pulling) as readily understood by a skilled artisan. In particular, alternative approaches include but are not limited to the following: vacuum or suction directed at the loosened liner 16 allowing the liner to be removed and the loosened explosives 18 to fall out; low pressure water washout or high pressure water jet washout after the loosened liner is removed via vacuum or pulled out with a mechanical unit attached to the liner; and gravity.

An exemplary method for releasing a compound from the dome end 22 of the casing 12, and, in particular, a preferred method for releasing the explosive 18 and cone shaped liner 16 from the dome end of a munition (e.g., grenade body 10) is described in greater detail below with reference to FIGS. 3 and 4 of the application. In particular, FIG. 3 is a side view, partially in section, of the extractor 50 in a start position; and FIG. 4 illustrates the extractor 50 of FIG. 3 in a push-out position.

In an initial phase of this extraction operation, a grenade body 10 is connected to the support device 52 adapted to stabilize the grenade body. While not being limited to a particular theory, the support device 52 can include any of the dejeter 60, the dejeter housing 62, the dejeter housing support 64, the back-up spring 66, and the grenade support 54. Preferably, the support device 52 at least includes the dejeter 60 or the grenade support 54. Referring to FIG. 3, the grenade body 10 is connected to both the dejeter 60 and the grenade support 54 by placing the grenade body on the grenade support and inserting the dejeter 60 into the open end 20 of the casing 12. While not being limited to a particular theory, the casing 12 in FIG. 3 is therefore connected to the grenade support 54 and the dejeter 60 of the extractor 50 with means using the structure of the support device 52 such as placing the grenade body 10 on the grenade support 54 and against the dejeter 60 by extending the dejeter into the open end 22 of the casing 12. The dejeter 60 slides into the open end 22 with a diameter equal or slightly less than the diameter of the interior side wall 26 at the open end. As can be seen in FIGS. 3 and 4, the dejeter 60 extends into the casing 12 to the liner 16 and provides support to the liner during the extraction process.

The grenade body 10 is placed in contact with the fluid port 74 such that the fluid port is adjacent the lead charge 14 located in the opening 38 of the dome end 22. The fluid port is urged or held against the casing 12, as shown in FIG. 3 by the back-up spring 66. The back-up spring 66 is shown in a compressed position in FIG. 3, whereby the compression spring pushes the dejeter 60 out of the dejeter housing 62 into the open end 24 and toward the fluid port 74. Accordingly, the grenade body 10 is stabilized by the dejeter 60, the back-up spring 66, the dejeter housing 62 and the dejeter housing support 64 on one end; by the fluid port 74 on an opposite end; and by the grenade support 54 underneath.

The dome end 22 of the casing 12 is further urged against the fluid port 74, providing a means for inserting the fluid port into the dome end. As can best be seen in FIG. 4, the urging and inserting is accomplished pneumatically by the compression cylinder 88, which is an exemplary pushing member. When actuated, the compression cylinder pneumatically pushes the dejeter housing 62 toward the grenade body 10 and forces the fluid port 74 into the opening 38 of the dome end 22 where the lead charge 14 is located. This action pushes the lead charge 14 into the explosive 18, seals the opening 38 with the fluid port 74, and provides an entry point for fluid (e.g, high pressure water) to follow. Accordingly, the fluid port 74 is inserted into the dome end 22 of the casing 12, placing the fluid port in fluid communication with the explosive 18.

While not being limited to a particular theory, the dejeter 60, back-up spring 66, dejeter housing 62, and pushing member (e.g., compression cylinder 88) are included as structure in a means for urging the dome end 22 against the fluid port 74.

In a subsequent stage of the extraction operation exemplified herein, a fluid is introduced through the fluid port 74 to the explosive 18 to separate the explosive from the dome end 22. Referring to FIGS. 2 and 4, as an exemplary means for introducing a fluid, the fluid pump 78 pushes fluid from the fluid supply 76 out of the fluid port 74 and into the grenade body 10 through the opening 38 at a pressure high enough to spread over the surface of the explosive 18 adjacent the interior side wall 26 of the casing 12. The pressure inside the dome end 22 increases as the fluid is pushed into the dome end because the seal between the fluid port 74 and the opening 38 is maintained during this stage. The fluid, which is preferably water, is continually forced into the casing 12 and creates enough pressure inside the dome end 22 to move the explosive 18 and shear or push the swedged cone liner 16 from the ridge 28 along the interior side wall 26 of the casing 12. As shown in FIG. 4, the explosive 18 is separated from the dome end 22 and the explosive 18 and liner 16 are pushed away from the dome end, releasing the explosive and liner from the dome end.

While it is noted above that high pressure water is used as the fluid in the preferred embodiment, it is understood that other fluids, including liquids and gases, may be used to release the explosive 18 and liner 16 from the dome end 22 of the grenade casing 10. It is also understood that other gases in addition to or including air, can be used by the compression cylinder 88 to move the dejeter housing 62 and the casing 12 against the fluid port 74 to insert the fluid port into the dome end 22 of the casing 12, and to create a seal of the opening 38. Moreover, pushing members alternative to the compression cylinder 88 may be used to insert the fluid port 74 into the dome end 22, as readily understood by a skilled artisan. What is important to the invention is that a fluid is inserted into the casing 12, creating enough pressure to push the explosive 18 away from the dome end 22. Alternative fluids and gases will become apparent to ones having ordinary skill in the art as needed in the application of this invention.

FIG. 4 is an exemplary illustration of the position of the explosive 18, liner 16 and tooling (e.g., dejeter 60, dejeter housing 62, back-up spring 66, dejeter housing support 64, hub 68, sleeve 70, air port 92, compression cylinder 88, etc.) after application of the fluid. After the explosive 18 and liner 16 release from their prior packed position in the grenade body 10 to their push-out position shown in FIG. 4, the fluid pressure automatically drops, the dejeter housing 62 retracts toward the compression cylinder 88, and the grenade body 10, with the loosened explosive 18 and liner 16, is removable from the extractor 50. As an exemplary means for removing the released explosive 18 and liner 16 from the casing, once the grenade body 10 is removed, the loosened explosive and liner can be safely and easily extracted from the grenade body 10 in a subsequent operation (e.g., tapping and rinsing, suction, mechanical attachment and pulling) as readily understood by a skilled artisan. The extractor 50 can then be readied for another extraction operation.

It should be apparent from the aforementioned description and attached drawings that the concept of the present application may be readily applied to a variety of preferred embodiments, including those disclosed herein. For example, munitions having various sizes and configurations may be used with the invention possibly requiring at most a resizing of the tooling. Moreover, the structure of the support device 52, the fluid source apparatus 56 and the air source apparatus 58 may be modified to support and access the munition in a variety of ways, as would readily be understood by a skilled artisan. Without further elaboration, the foregoing will also fully illustrate the invention that others may, by applying current or future knowledge, readily adapt the same for use under various conditions of service.

It should be understood that many modifications, variations and changes may be made without departing from the spirit and scope of the invention as defined in the claims.

What is claimed is:

1. An extractor for releasing a compound from a dome end of a munition, the munition including a casing having an open end opposite the dome end, a liner inside the casing with a flange of the liner mechanically coupled to the casing and directed toward the open end, and the compound enclosed in the casing between the dome end and the liner, the extractor comprising:

a support device connected to the casing, said support device adapted to stabilize the casing as the compound is released from the dome end; and a fluid port adjacent the dome end of the casing, said fluid port adapted to introduce a fluid through the dome end to the compound to release the compound by separating the compound from the dome end and to shear the mechanical coupling between the liner and the casing.

2. The extractor of claim 1, wherein said support device is slidingly engaged within the open end of the casing.

3. The extractor of claim 1, said support device including a dejeter slidingly engaged within the open end of the casing adjacent the liner to support the liner.

4. The extractor of claim 3, further comprising a munition support that holds the munition.

5. The extractor of claim 3, wherein the casing includes an opening in the dome end, the munition includes a lead charge in the opening adjacent the compound, and said fluid port abuts the lead charge.

6. The extractor of claim 1, further comprising a fluid source in fluid communication with said fluid port to provide the fluid to said fluid port.

7. The extractor of claim 1, said support device including a dejeter housing and a dejeter slidingly engaged with said dejeter housing, said dejeter adapted to contact and stabilize the casing.

8. The extractor of claim 7, said support device further including a compression spring between said dejeter and said dejeter housing, said compression spring resisting axial sliding of said dejeter into said dejeter housing.

9. The extractor of claim 7, said support device further including a dejeter housing support that holds said dejeter housing axially aligned with the casing.

10. The extractor of claim 1, further comprising a pushing member adapted to urge said fluid port through the dome end to provide fluid communication from said fluid port to the compound.

11. The extractor of claim 10, wherein said pushing member is connected to said support device to urge said support device and the casing against said fluid port.

12. The extractor of claim 10, wherein the casing includes an opening in the dome end and said fluid port is urged into the opening by said pushing member.

13. The extractor of claim 10, wherein said pushing member includes a pneumatically operated compression cylinder that urges said support device and the casing toward said fluid port.

14. The extractor of claim 13, wherein said pushing member also includes a rod connecting said compression cylinder to said support device.

15. The extractor of claim 1, wherein the fluid is a pressurized water.

16. An extractor for releasing a compound from a dome end of a casing, the casing having an open end opposite the dome end, the extractor comprising:

a support device connected to the casing, said support device adapted to stabilize the casing as the compound is released from the dome end; and a fluid port sealingly abutting the dome end of the casing, said fluid port adapted to introduce a fluid through the dome end to the compound to release the compound by separating the compound from the dome end, wherein the compound is a packed explosive.

17. A method for releasing an explosive from a munition, the munition including a casing having an open end, a dome end opposite the open end, a liner inside the casing with a flange of the liner mechanically coupled to the casing and directed toward the open end, and the explosive enclosed in the casing between the dome end and the liner, the method comprising:

inserting a fluid port into the dome end of the casing; and introducing a fluid through the fluid port to the explosive to release the explosive by separating the explosive from the dome end and to shear the mechanical coupling between the liner and the casing.

18. The method of claim 17, further comprising removing the released explosive from the casing.

19. An extractor for releasing an explosive from a munition, the munition including a casing having an open end, a dome end opposite the open end, a liner inside the casing with a flange of the liner mechanically coupled to the casing and directed toward the open end, and the explosive enclosed in the casing between the dome end and the liner, the apparatus comprising:

means for inserting a fluid port into the dome end of the casing; and means for introducing a fluid through the fluid port to the explosive to release the explosive by separating the explosive from the dome end and to shear the mechanical coupling between the liner and the casing.

20. The extractor of claim 19, further comprising means for removing the released explosive and liner from the casing.

* * * * *